US005771644A

United States Patent [19]

Kidd

[11] Patent Number: 5,771,644

[45] Date of Patent: Jun. 30, 1998

[54] DOOR FRAME ANCHORING CLIP

[76] Inventor: Duane L. Kidd, 1056 Olympia Dr., Mason, Ohio 45040

[21] Appl. No.: 672,743

[22] Filed: Jun. 28, 1996

[51] Int. Cl.[6] ..... E06B 1/60

[52] U.S. Cl. ..... 52/213; 49/504; 52/204.1; 52/215; 52/745.15

[58] Field of Search ..... 49/504, 505; 52/204.1, 52/204.53, 210, 211, 213, 215, 745.15, 745.16

[56] References Cited

U.S. PATENT DOCUMENTS

| | | | |
|---|---|---|---|
| 1,068,656 | 7/1913 | Holmes . | |
| 1,071,911 | 9/1913 | Hale . | |
| 1,150,790 | 8/1915 | Swanson . | |
| 1,271,210 | 7/1918 | Otte | 52/216 X |
| 1,905,124 | 4/1933 | Baum . | |
| 1,926,673 | 9/1933 | Gregg | 52/215 X |
| 2,582,765 | 1/1952 | Brew . | |
| 2,598,139 | 5/1952 | Shea | 52/213 X |
| 3,019,868 | 2/1962 | Truman et al. | 49/504 |
| 3,103,263 | 9/1963 | Leeser . | |
| 3,156,331 | 11/1964 | Sklar | 52/215 |
| 3,222,833 | 12/1965 | Woodrum | 49/505 X |
| 3,445,977 | 5/1969 | Latiano | 49/505 X |
| 3,788,019 | 1/1974 | Kiselewski . | |
| 4,223,494 | 9/1980 | Wendt . | |
| 4,226,066 | 10/1980 | Persson | 52/213 X |
| 4,281,480 | 8/1981 | Wendt . | |
| 4,510,722 | 4/1985 | Van Wieringen | 52/213 |
| 4,513,549 | 4/1985 | Wendt . | |
| 4,539,784 | 9/1985 | Allen | 52/745.16 X |
| 4,637,183 | 1/1987 | Metz . | |
| 4,674,248 | 6/1987 | Hall | 52/213 X |
| 5,154,019 | 10/1992 | Day . | |

FOREIGN PATENT DOCUMENTS

| | | | |
|---|---|---|---|
| 132462 | 5/1949 | Australia | 52/215 |

OTHER PUBLICATIONS

Steel Doors, Frames and Entrance Systems, Steelcraft by American Standard, pp. 1–19, Catalog No. 513, 1982.

*Primary Examiner*—Carl D. Friedman
*Assistant Examiner*—Kevin D. Wilkens
*Attorney, Agent, or Firm*—Wood, Herron & Evans, L.L.P.

[57] ABSTRACT

An anchoring clip for the installation of a hollow door or window frame in stud or masonry walls that minimizes the need for additional hardware when installing a hollow door or window frame because the clip can be used along the entire height of either the strike jamb or the hinge jamb of the door frame, across the header of the door frame or at the base of the door frame for secure attachment to both the wall and the floor surrounding the door opening. Furthermore, the anchoring clip can be used for new construction or existing walls without marring the wall finishes or cutting a hole in the walls for the installation of the door frame.

28 Claims, 2 Drawing Sheets

DOOR FRAME ANCHORING CLIP

BACKGROUND OF THE INVENTION

This invention relates to an attachment mechanism for door and window frames and more particularly to a clip for securing a hollow door frame to a wall surrounding a door opening.

Construction techniques and components featuring quick installation and field adaptability to particular construction requirements have become very desirable in recent years. In particular, the quick and secure installation of door frames around the perimeter of a door opening in a wall for both new construction and remodeling is very desirable. Commonly, door frames consist of extruded metal or vinyl elements which in combination provide a hollow door frame so that the attachment hardware for the door frame to the wall can be concealed within the hollow door frame. The door frame components include a hinge jamb member for the secure attachment of hinges connected to a door and an opposing strike jamb member including a stop and cut-out for receiving the strike plate for cooperation with the strike and door latch mechanism on the door. A header of the door frame extends across the top of the door opening. The door frame can be assembled from a knock-down configuration or be provided in a prefabricated or welded design for installation into the door opening in the wall.

Commonly, anchoring devices are required to secure the door frame and door frame components to the wall surrounding the door opening. One known technique for anchoring the door frame to the wall is to secure an anchoring device inside the hollow door frame prior to the installation of the door frame on the wall. Once the anchoring device is secured to the door frame, the assembly can then be anchored to the wall stud within the wall surrounding the door opening. A significant problem with this technique which is particularly applicable when the door frame is being installed into an existing wall structure is that access to the anchoring device seated within the hollow door frame elements must be provided in order to anchor the assembly to the wall stud. As a result, typically a portion of the dry wall or other finished component of the wall must be cut or removed so that the installer can gain access through the resulting cavity to the anchoring device within the door frame from outside the perimeter of the door opening. This is clearly undesirable in that the finished wall must be damaged, cut or otherwise mutilated in order to gain access to the anchoring device embedded in the door frame for installation of the door frame assembly into the door opening. After the door frame assembly is secured to the wall surrounding the door opening, the hole or other damage to the wall surrounding the door opening must then be repaired.

Another aspect of conventional techniques for installing hollow door frames is the requirement for hinge members, securing plate members, door stops, trim plates, strike plates, and an array of necessary attachment hardware components. Specifically, anchoring devices for the strike jamb of the door frame are often specifically designed for the strike jamb and cannot be used in the header door frame member or the hinge jamb. In many known designs, the jamb at the strike side of the door opening requires a different shape and design of installation device than the jamb at the hinge side of the door opening. Moreover, pre-cut notches for attachment of a strike plate and other necessary components limits the availability to provide universal support structures to be used at various door locations having different strike plate height requirements.

As a result, the installer must stock, transport and utilize numerous different components and hardware items for securing the hollow door frame to the door. Additionally, a different device is commonly required at the base of each jamb member for securing the door frame assembly to the wall. Large inventories of hardware and other components are cumbersome, expensive and counterproductive to providing a quick, simple and easily accomplished door frame installation.

Additionally, another concern with respect to the installation of hollow door frames is the resulting strength or stability of the installed door frame assembly. Because the door frames are hollow, their strength is often limited compared to more structurally rigid solid designs. Furthermore, conventional solid core doors may range up to 150 pounds in weight and sufficient strength of the door frame assembly is required and cannot be compromised by the attachment mechanism of the door frame assembly to the wall. Moreover, any additional measures or features which can be used to increase the strength of the hollow door frame assembly supporting the door are highly desirable.

SUMMARY OF THE INVENTION

It has therefore been a primary objective of this invention to provide an improved anchoring device for the quick and efficient installation of hollow door frames.

It has been another objective of this invention to provide such an anchoring device of which installation does not require access via the wall surrounding the door opening and mutilation or damage to the wall in securing the device to the wall.

It has been a still further objective of this invention to provide such an anchoring device which can readily be installed during new construction or in conjunction with the remodeling of an existing structure. Similarly, such a device should be useful both for knock-down type hollow door frames and preassembled or welded door frame designs.

It has been a still further objective of this invention to provide such an anchoring device which is versatile and can be used on the header, the strike jamb or hinge jamb side of the door frame, along the entire height of the door frame and at the base of the door frame at the junction between the wall and the floor for securing the door frame thereto.

A still further objective of this invention has been to provide such an improved anchoring device which provides added strength and enhanced stability to the installed door and door frame assembly.

These and other objectives of the invention have been attained by an anchoring clip according to a presently preferred embodiment which can be used along the strike jamb, header or hinge jamb of the door frame. Furthermore, the anchoring clip can be used anywhere along the height of the door frame including at the base of the strike jamb or hinge jamb for secure attachment to both the wall and the surrounding floor.

The anchoring clip of this invention is secured to the wall stud in the wall surrounding the door opening or to the wall stud and floor if the clip is located at the junction between the wall and the floor. In one aspect of the invention, after the clips have been secured to the wall and/or floor, the hollow door frame members are snap engaged onto the clips by forcing a terminal lip of each door frame member over deflectable extension flanges on the clips. After the terminal lips of the door frame members pass the outer edge of the extension flanges, the flanges deflect outwardly to be seated within the hollow door frame and anchor the door frame to the wall and/or floor. In another aspect, the clips can be pre-assembled into the hollow door frame and the resulting door frame assembly anchored to the wall and floor.

The anchoring clip according to a presently preferred embodiment is generally U-shaped and includes a backplate web and a pair of opposed extension flanges each projecting from a side edge of the backplate web. The backplate web is juxtaposed to the wall stud joining the opposing faces of the wall at the perimeter of the door opening. Another feature of the anchoring clip according to this invention is a pair of centering tabs projecting from the backplate web to center the clip relative to the opposing faces of the wall.

A bottom flange projects from a bottom edge of the clip and is configured for insertion into the door frame to provide added strength to the hollow door frame elements. The bottom flange includes a brace which projects outwardly and into a jamb stop of the door frame when the clip is inserted therein. A fastener may be used to secure the jamb stop to the brace and add further strength and rigidity to the door frame and clip assembly.

Advantageously, when the anchoring clip is used at the base of the strike jamb or hinge jamb of the door frame it is secured both to the wall and to the floor. The bottom flange includes apertures adapted to receive drive pins or similar fasteners to secure the bottom flange to the floor. Moreover, the bottom flange includes an upturned tang at a terminal edge thereof which allows for vertical adjustments of the door frame without resulting in a gap between the floor and the door frame.

If additional anchoring is required, a screw or other fastener can be inserted through the terminal lip of the door frame and into a V-shaped notch at the outer edge of each extension flange. The V-shaped notch is deflectable to allow for the snap-fit engagement of the door frame onto the clip. Moreover, the shape of the notch directs and focuses the screw during its installation and also provides a substantial anchorage point for vertical adjustments during the door frame installation as required for unlevel floors or irregular door openings.

It will be appreciated that the anchoring clip according to this invention significantly reduces the hardware components required for installing a hollow door frame to the wall and floor surrounding the door opening. The snap fit engagement of the door frame elements onto the anchoring clip of this invention minimizes the variety of fasteners required for installing a hollow door frame into a door opening. Additionally, the clip provides the versatility for use in new construction or existing walls both with knock down or preassembled door frame designs.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
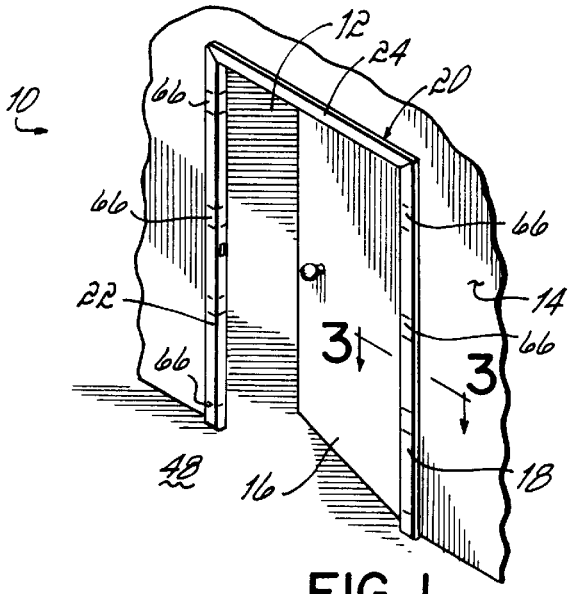
FIG. 1 is a perspective view of a door and a door frame assembly installed in a door opening in a wall.

Referring to FIG. 1, a door frame assembly 10 is shown installed into a door opening 12 in a wall 14. The door frame assembly 10 includes a door 16 pivotally suspended as by hinges (not shown) to a hinge jamb 18 of a door frame 20. The door 16 is pivotal between the open position as shown in FIG. 1 and a closed position (not shown) in which the door 16 mates with a strike jamb 22 of the door frame 20. The strike jamb 22 and hinge jamb 18 are connected by a header 24 of the door frame 20.

Figure 2:
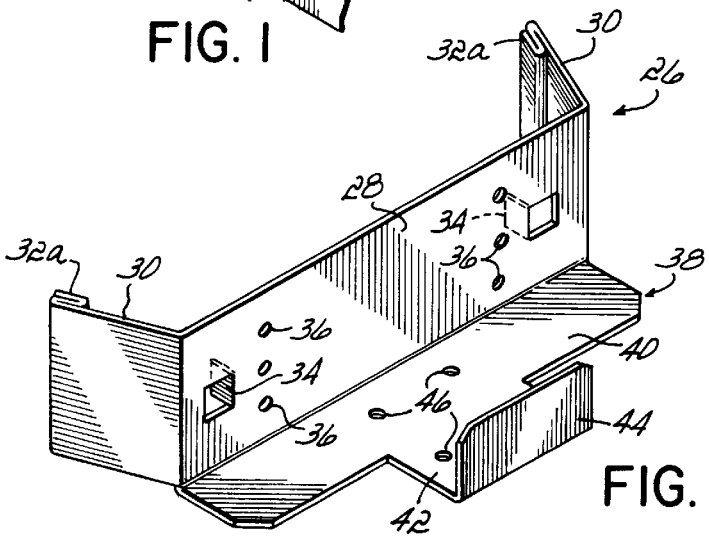
FIG. 2 is a perspective view of a presently preferred embodiment of an anchoring clip according to this invention.

A presently preferred embodiment of an anchoring clip 26 according to this invention is shown in FIG. 2. The anchoring clip 26 is preferably sheet metal and generally U-shaped including a backplate web 28 and opposed extension flanges 30 each projecting obliquely from a side edge of the backplate web 28. A V-shaped tab 32 is formed on the outer edge of each extension flange 30 and extends preferably the entire height of the extension flange 30. For fabrication purposes, preferably the V-shaped tabs 32 are formed by bending the sheet metal of the extension flange 30 into the shape shown in FIGS. 3–4. The V-shaped tab 32 is preferably deflectable and collapsible with a pliers, hammer or other tool as shown in FIG. 2 and the purpose of which will be described later herein.

Centering tabs 34 project rearwardly from the backplate web 28. Preferably, the centering tabs 34 are stamped from the backplate web 28 material and are bent rearwardly to project generally perpendicularly from the plane of the backplate web 28. Additionally, apertures 36 are provided in the backplate web 28 for securing the clip 26 to the wall 14 surrounding the door opening 12.

A bottom flange 38 projects forwardly from a bottom edge of the backplate web 28. The bottom flange 38 includes a base portion 40 preferably extending the entire width of the backplate web 28 and a narrow brace 42 projecting from the outer edge of the base portion 40 which terminates in an upturned tang 44. Apertures 46 are provided in the bottom flange 38 to secure the clip 26 to a floor 48 (FIGS. 1 and 4) surrounding the door opening 12.

Figure 3:
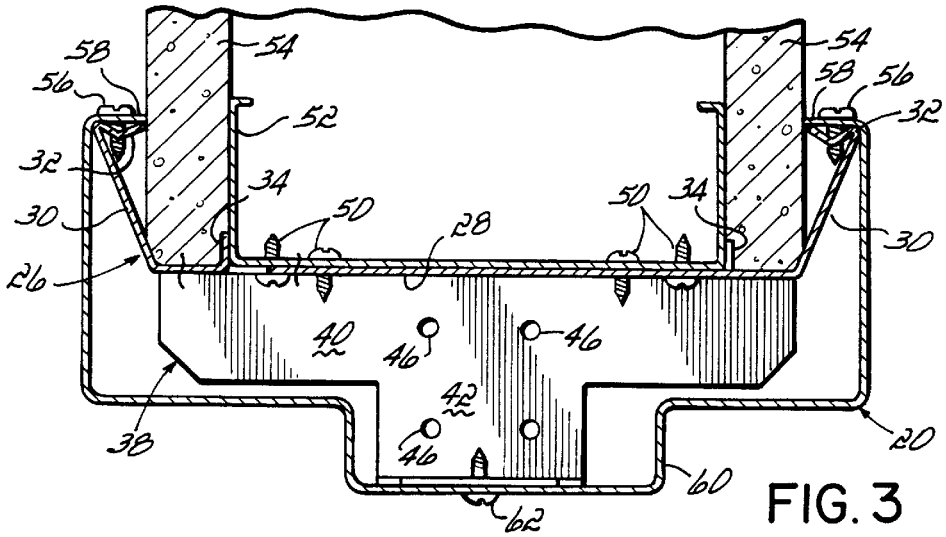
FIG. 3 is a cross-sectional view taken along line 3—3 of FIG. 1 showing the anchoring clip secured to the wall and retaining the hollow door frame member.

Referring to FIG. 3, wall fasteners 50, preferably standard S-12 type screws, are used to attach the backplate web 28 to a wall stud 52 which separates spaced wall panels 54 of the wall 14. The screws or other wall fasteners 50 project through the holes 36 of the backplate web 28 and into the wall stud 52. The centering tabs 34 projecting rearwardly from the backplate web 28 are spaced and sized to mate with the opposing side edges of the wall stud 52 and thereby center the anchoring clip 26 relative to the opposing wall panel faces 54. It will be appreciated that the centering tabs 34 are sized and spaced to coordinate with the width of the particular wall stud 52 being used. The centering tabs 34 provide for the self-centering of the anchoring clip 26 thereby saving time and possible errors when plumbing the door frame 20 with the wall 14.

Also shown in FIG. 3 are the preferably V-shaped anchoring tabs 32 at the terminal edges of the extension flanges 30. The anchoring tabs 32 secure the anchoring clips 26 to the hollow door frame 20 by a frame fastener 56, preferably a self-tapping screw which is inserted through a terminal lip 58 of the door frame 20 and into the anchoring tab 32. Alternatively, the anchoring tabs 32 can be compressed or deflected with a pliers, hammer or other tool as shown in FIG. 2 before installation of the door frame 20 onto the anchor clip 26. The compressed anchoring tabs 32*a* permit the frame 20 to be pushed over the extension flanges 30 and locked into position with a distinct "popping" sound as the frame 20 is snap engaged and fully seated into position as shown in FIG. 3.

The length of the extension flanges 30 are designed to allow the wall 54 to extend into the throat region of the clips 26 defined by the extension flanges 30 and the backplate web 28 for proper wall surface coverage of the door opening 12 while adding stability to the frame 20. It will be appreciated that the anchoring clip 26 can be secured to the wall stud 52 of a finished wall by inserting the screws or fasteners 50 through the front face of the backplate web 28 and into the stud 52. Additionally, in an unfinished wall the screws or fasteners 50 can be inserted through the wall stud 52 and into any solid area of the rear face of the backplate web 28 also as shown in FIG. 3. This allows for quick installation of the frame 20 during the wall framing process which is a highly desirable advantage. Installation in an unfinished wall may be accomplished by inserting the anchoring clip 26 within the hollow door frame 20 and inserting the screws or other fasteners 56 into the terminal lip 58 of the door frame 20 and into the V-shaped anchoring tabs 32. The configuration of the V-shaped tabs 32 focuses and directs the self-tapping screw 56 being inserted through the terminal lip 58 of the door frame 20 thereby providing for easier and quicker installation. The anchoring clip 26 and door frame assembly 20 can then be secured to the wall stud 52 by inserting the screws 50 through the wall stud 52 and into the back face of the backplate web 28. This is accomplished by inserting the screws 50 from behind the stud 52 through an open wall cavity (not shown).

The base portion 40 of the bottom flange 38 is sized and configured to extend into the hollow door frame 20 as shown in FIG. 3. Additionally, the brace 42 projecting outwardly on the bottom flange 38 is designed to extend into a stop portion 60 of the door frame 20. Advantageously, the configuration of the bottom flange 38 including the base portion 40 and the brace 42 projects into the contour of the hollow door frame 20 and in a most preferred embodiment substantially fills the interior of the hollow door frame 20. The length of the brace 42 on the bottom flange 38 is determined by the depth of the hollow door frame 20 and whether or not the frame has a pre-formed stop 60 as shown in FIG. 3. As a result, the anchoring clip 26 provides additional structural stability and reinforcement to the hollow door frame 20. Furthermore, the upturned tang 44 on the outer edge of the brace 42 is preferably juxtaposed to the inner surface of the stop 60 on the door frame 20 which provides a tight friction fit within the stop 60, while providing a substantial backing plate for a stop fastener or screw 62 which can be inserted through the stop 60 and into the tang 44 for an additional anchoring point as shown in FIG. 3.

Advantageously, the design of the presently preferred embodiment of the anchoring clip 26 makes the clip 26 reversible so it can be used on either the strike jamb 22 or hinge jamb 18 of the frame 20 or the header 24. The total height of the anchoring clip 26 is designed to be less than the width of the pre-formed casing of the door frame 20 to be installed so that the clip 26 can be used when installing a knock-down type frame in an existing wall.

When the anchoring clip 26 is used at the base of the strike jamb 22 or hinge jamb 18 of the door frame 20 proximate the intersection of the wall 14 and floor 48, fasteners 64 (FIG. 4), preferably standard one-quarter inch metallic tap-it drive pins are inserted through the holes 46 in the bottom flange 38 to secure the anchoring clip 26 to the floor 48. When the clip 26 is used in this way as a base anchor for the door frame 20 it can be additionally secured to the wall stud 52 thereby providing additional attachment points for the door frame assembly 10. The screws 56, which are preferably self-tapping, inserted through the terminal lip 58 of the door frame 20 and into the V-shaped tabs 32 are helpful when the anchoring clip 26 is used as a base anchor for leveling the door frame 20 when the surrounding floor 48 is unlevel and one or both sides of the frame 20 need to be raised before anchoring the frame 20 in position. Additionally, when the anchoring clip 26 is used as a base anchor and attached to the floor 48, the upturned tang 44 is helpful to accommodate vertical adjustments of the door frame 20.

Figure 4:
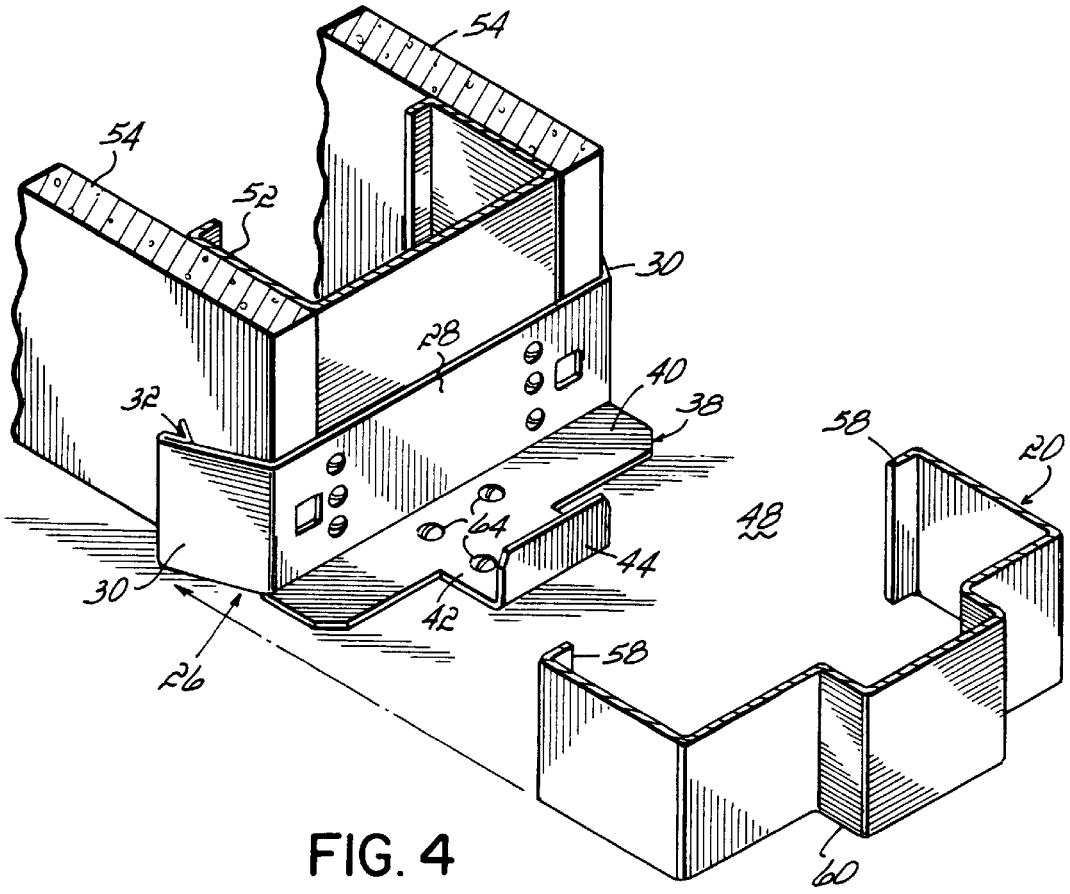
FIG. 4 is a partially broken away perspective view of the anchoring clip secured at the junction between the floor and a wall stud with a hollow door frame member being installed thereon.

As shown in FIG. 4, in an existing wall 14 the anchoring clip 26 is secured to the wall stud 52 with the screws 50 through the holes 36 in the backplate web 28 and the anchoring pins 64 through the holes 46 in the bottom flange 38 and into the floor 48. The hollow door frame 20 is then snap fit engaged over the anchoring clip 26 secured to the wall stud 52 and floor 48.

A presently preferred method of installing the knock-down type hollow door frame 10 with the anchoring clip 26 is as follows. The anchoring clips 26 are secured to the rough door opening 12 in the eight locations 66 shown in FIG. 1. After the clips 26 are secured to the door opening 12, the bottom of one of the jamb frame members 18 or 22 is slid down over the lowermost clip proximate the floor 48 on the appropriate side of the door opening 12. The V-shaped tabs 32 on the lowermost clip 26 are preferably not collapsed. The jamb frame member 18 or 22 is then pivoted upwardly to mate with the remaing three clips 26 on that side of the door opening 12 with the frame member 18 or 22 being snap-engaged onto the remaining three clips 26, each of which have their respective V-shaped tabs 32 collapsed for easier snap-engagement. The jamb frame member 18 or 22 is now in position on the first side of the door opening 12, but it is not securely fastened at this time.

Next, the header 24 is installed on the door opening 12 and pushed upwardly. The end of the header 24 near the installed jamb side frame member 18 or 22 is initially inserted and the header 24 is then pivoted upwardly to a generally horizontal position at the top of the door opening 12. The end of the header 24 proximate the second side of the door opening 12 is pushed upwardly past the total height of the second jamb frame member 22 or 18. Then the bottom end of the second jamb frame member 22 or 18 is slid over the lowermost clip 26 on the second side of the door opening 12. The jamb frame member 22 or 18 is then pivoted toward a vertical orientation until the upper end thereof clears the header 24 and the jamb frame member 22 or 18 is snap-fit onto the three remaing clips 26 on this side of the door opening 12 each with collapsed V-shaped tabs 32.

With the frame members 18, 22 installed on the clips 26 as described, the header 24 is pulled downwardly into position until all of the miter joints between the header 24 and side frame members 18, 22 are connected. Many knock-down type of door frames 10 include tabs and slots (not shown) to secure the mitered joints together. The frame 10 can now be vertically adjusted to level the header 24. If one or both of the jamb frame members 18, 22 need to be raised to level the header 24, the appropriate jamb frame member 18, 22 is slid upwardly on the clips 26 into the proper vertical position. Fasteners 56 are then inserted through the terminal lips 58 of the jamb frame members 18, 22 and into the two V-shaped tabs 32 on each of the lowermost clips 26 on each side of the door opening 12. Once the installation of the knock-down door frame 10 is completed and adjusted for a level orientation, the hinges and door 16 can subsequently be installed.

It will be appreciated that the design of the anchoring clip 26 according to the presently preferred embodiment of this invention allows it to be used at any normal anchoring position including the header 24 and along the height of the strike jamb 22 or hinge jamb 18 of the hollow door frame 20. Additionally, the anchoring clip 26 can be used as a base anchor for secure attachment to the floor 48 of the door frame assembly 10 thereby eliminating the need for a combination of various types of other anchors and hardware presently used to install a variety of hollow door frames. Moreover, the anchoring clip 26 is entirely concealed within the frame 20 in each of the described and varied modes of installation.

From the above disclosure of the general principles of the present invention and the preceding detailed description of a preferred embodiment, those skilled in the art will readily comprehend the various modifications to which this invention is susceptible. Therefore, I desire to be limited only by the scope of the following claims and equivalents thereof.

I claim:

1. A door frame comprising in combination:

a hollow door frame having a hinge jamb, a strike jamb and a header for installation into a door opening; and a plurality of generally U-shaped clips securing the door frame to a wall surrounding the door opening, each of the clips further comprising:

(1) a backplate web and a pair of opposed extension flanges each projecting from a side edge of the backplate web, the backplate web being juxtaposed to a wall stud joining opposing faces of the wall surrounding the door opening and the extension flanges being inserted within the door frame and engaging the frame, a first one of the U-shaped clips being secured to the wall at a bottom of the hinge jamb proximate an intersection of the wall and a floor, a second one of the U-shaped clips being secured to the wall at a position remote from the intersection and along a height of the hinge jamb, a third one of the U-shaped clips being secured to the wall at a bottom of the strike jamb proximate the intersection of the wall and the floor and a fourth one of the U-shaped clips being secured to the wall at a position remote from the intersection and along a height of the strike jamb;

(2) a plurality of wall fasteners securing the clip to the wall, wherein the extension flanges retain the door frame to the wall; and (3) a bottom flange projecting from a bottom edge of the clip, a portion of the bottom flange being inserted into the door frame to provide added strength to the door frame, the bottom flange of the first and fourth clips also being attached to the floor proximate the wall;

wherein the first and fourth clips further comprise:

a plurality of floor fasteners securing the bottom flange of the first and fourth clips to the floor.

2. The combination of claim 1 further comprising:

a door hingedly connected to the hinge jamb of the door frame.

3. The combination of claim 1 further comprising:

a V-shaped tab on each extension flange to focus and capture a frame fastener inserted into a terminal lip of the frame.

4. The combination of claim 1 further comprising:

a pair of centering tabs projecting from the backplate web to center the clip relative to the opposed faces of the wall, wherein the entire device is concealed within the installed door frame.

5. The combination of claim 1 wherein the door frame is selected from one of the following types of construction: welded and knock-down.

6. A device for installing a hollow door frame around a door opening in a wall, the device comprising:

a generally U-shaped clip having a backplate web and a pair of opposed extension flanges each projecting from a side edge of the backplate web, the backplate web adapted for being juxtaposed to a wall stud joining opposing faces of the wall and the extension flanges adapted for being inserted within the door frame to engage the frame, the U-shaped clip being adapted for use at a bottom end of the door frame, along an entire height of a hinge jamb of the door frame, and along an entire height of a strike jamb of the door frame;

a plurality of wall fasteners for securing the clip to the wall, wherein the extension flanges retain the door frame when the clip is secured to the wall by the wall fasteners and the device is inserted into the door frame;

a bottom flange projecting from a bottom edge of the clip, a portion of the bottom flange being configured for insertion into the door frame to provide added strength to the door frame, the bottom flange also being capable of secure attachment to the floor proximate the wall when the clip is secured to the wall proximate the intersection of the wall and the floor; and a pair of centering tabs projecting from the backplate web adapted to center the clip relative to the opposed faces of the wall, wherein the entire device is adapted to be concealed within the installed door frame.

7. The device of claim 6 further comprising:

a plurality of floor fasteners to secure the bottom flange to the floor when the device is used proximate the intersection of the floor and the wall and the bottom flange is juxtaposed to the floor.

8. The device of claim 6 wherein each extension flange is deflectable inwardly toward the opposite extension flange so that when the clip is secured to the wall the door frame can be forced onto the clip thereby deflecting the extension flanges inwardly until a terminal lip of the frame captures the extension flange and allows the extension flange to deflect outwardly within the door frame.

9. The device of claim 6 further comprising:

a brace connected to a terminal edge of the bottom flange, the brace being inserted into a jamb stop of the door frame when the clip is inserted in the door frame to provide added strength and support to the door frame.

10. The device of claim 9 further comprising:

a stop fastener for securing the brace to the jamb stop by inserting the stop fastener through the jamb stop and into the clip.

11. The device of claim 6 further comprising:

an upturned tang on a terminal edge of the bottom flange, the upturned tang allowing for vertical adjustments of the door frame and providing a backing plate for a stop fastener joining the clip and the jamb stop.

12. A device for installing a hollow door frame around a door opening in a wall, the device comprising:

a generally U-shaped clip having a backplate web and a pair of opposed extension flanges each projecting from a side edge of the backplate web, the backplate web adapted for being juxtaposed to a wall stud joining opposing faces of the wall and the extension flanges adapted for being inserted within the door frame to engage the frame, the U-shaped clip being adapted for use at a bottom end of the door frame, along an entire height of a hinge jamb of the door frame, and along an entire height of a strike iamb of the door frame:

a plurality of wall fasteners for securing the clip to the wall, wherein the extension flanges retain the door frame when the clip is secured to the wall by the wall fasteners and the device is inserted into the door frame:

a bottom flange projecting from a bottom edge of the clip, a portion of the bottom flange being configured for insertion into the door frame to provide added strength to the door frame, the bottom flange also being capable of secure attachment to the floor proximate the wall when the clip is secured to the wall proximate the intersection of the wall and the floor; and a V-shaped tab on each extension flange adapted to receive a frame fastener inserted into a terminal lip of the frame when the device is inserted in the door frame.

13. The device of claim 12 wherein the V-shaped tabs are collapsible to allow for assembly of the device with the door frame.

14. A device for installing a hollow door frame around a door opening in a wall, the device comprising:

a generally U-shaped clip having a backplate web and a pair of opposed extension flanges each projecting from a side edge of the backplate web, the backplate web adapted for being juxtaposed to a wall stud joining opposing faces of the wall;

a plurality of wall fasteners for securing the clip to the wall, wherein the extension flanges retain the door frame when the clip is secured to the wall by the wall fasteners and the device is inserted into the door frame;

a V-shaped tab on each extension flange; and a frame fastener inserted into a terminal lip of the door frame and one of the V-shaped tabs when the device is inserted in the door frame, wherein the V-shaped tab focuses and captures the frame fastener inserted therein to further secure the door frame to the device.

15. The device of claim 14 wherein the V-shaped tabs are collapsible to allow for assembly of the device with the door frame.

16. A device for installing a hollow door frame around a door opening in a wall, the device comprising:

a generally U-shaped clip having a backplate web and a pair of opposed extension flanges each projecting from a side edge of the backplate web, the backplate web adapted for being juxtaposed to a wall stud joining opposing faces of the wall, the U-shaped clip being adapted for use at a bottom end of the door frame proximate an intersection of the wall and a floor, along an entire height of a hinge jamb of the door frame, and along an entire height of a strike jamb of the door frame;

wherein each extension flange is deflectable inwardly toward the opposite extension flange so that when the clip is secured to the wall the door frame can be forced onto the clip thereby deflecting the extension flanges outwardly until a terminal lip of the frame captures the extension flange and allows the extension flange to deflect outwardly within the door frame;

a plurality of wall fasteners for securing the clip to the wall, wherein the extension flanges retain the door frame when the clip is secured to the wall by the wall fasteners and the device is inserted into the door frame;

a bottom flange projecting from a bottom edge of the clip, a portion of the bottom flange being configured for insertion into the door frame to provide added strength to the door frame, the bottom flange also being capable of being secured to the floor proximate the wall when the clip is secured to the wall proximate the intersection of the wall and the floor;

a plurality of floor fasteners to secure the bottom flange to the floor when the device is used proximate the intersection of the floor and wall;

a V-shaped tab on each extension flange;

a frame fastener inserted into one of the V-shaped tabs and adapted to be inserted into a terminal lip of the frame when the device is inserted in the door frame, wherein the V-shaped tab focuses and captures the frame fastener inserted therein;

a pair of centering tabs projecting from the backplate web adapted to center the clip relative to the opposed faces of the wall, wherein the entire device is adapted to be concealed within the installed door frame;

a brace connected to a terminal edge of the bottom flange, the brace being inserted into a jamb stop of the door frame when the clip is inserted in the door frame to provide added strength and support to the door frame;

a stop fastener for securing the brace to the jamb stop by inserting the stop fastener through the jamb stop and into the clip;

an upturned tang on a terminal edge of the brace, the upturned tang allowing for vertical adjustments of the door frame and providing a backing plate for the stop fastener.

17. A method for installing a hollow door frame around a door opening in a wall, the method comprising the steps of:

securing a backplate web of each of a plurality of generally U-shaped clips to a wall stud at a periphery of the door opening between opposing faces of the wall, a first one of the clips being secured to the wall proximate an intersection of the wall and a floor and a second one of the clips being secured at a location on the wall remote from the intersection;

securing a bottom flange of the first one of clips to the floor, the bottom flange projecting from a bottom edge of the clip; and pushing the door frame onto each of the clips by deflecting opposing extension tabs projecting from side edges of the backplate web inwardly toward the opposite extension tab, the extension tabs on each of the clips deflecting outwardly away from one another once a terminal lip on the door frame is pushed past each extension tab to thereby secure the clip and door frame together and install the door frame around the door opening in the wall.

18. The method of claim 17 wherein at least one of the clips being secured to the wall stud is on a hinge jamb side of the door opening and another one of the clips is secured to a strike jamb side of the door opening.

19. The method of claim 17 further comprising:

inserting a fastener through the terminal lip of the door frame and into a V-shaped notch on each extension tab which focuses and captures the fastener.

20. The method of claim 17 further comprising:

centering the clips on the wall stud with centering tabs projecting from the backplate web of each clip prior to securing the clip to the wall.

21. The method of claim 17 wherein the door frame is installed in the door opening with the clips without damaging the wall surrounding the door opening.

22. The method of claim 17 wherein each of the clips is secured to the wall prior to pushing the door frame onto the clips and the door frame entirely conceals each of the clips when pushed thereon.

23. The method of claim 22 further comprising:

collapsing a V-shaped notch on each of the extension flanges.

24. The method of claim 17 further comprising:

inserting a portion of the bottom flange into a stop of the door frame when the door frame is pushed onto the clips.

25. The method of claim 24 further comprising:

inserting a fastener through the door frame and into a tang on the bottom flange thereby more securely joining the clips and the door frame.

26. A method of assembling a door frame comprising the steps of:

pushing the door frame onto a plurality of clips by deflecting opposing extension tabs projecting from side edges of a backplate web on each clip inwardly toward the opposite extension tab on each of the clips, the extension tabs deflecting outwardly away from one another on each of the clips once a terminal lip on the door frame is pushed past the extension tab to thereby secure the clip and door frame together and envelop the clips within the door frame;

wherein a first one of the clips is secured to the door frame proximate a bottom end of the door frame for subsequent attachment to a floor, a second one of the clips is secured at a distance spaced from the bottom end of the door frame within a hinge jamb of the door frame, and a third one of the clips is secured at a distance spaced from the bottom end of the door frame within a strike jamb of the door frame; and inserting a bottom flange of each of the clips into the door frame while the door frame is being pushed onto the clips to thereby reinforce the door frame.

27. The method of claim 26 further comprising:

inserting a fastener through the door frame and into a tang on the bottom flange to thereby more securely join the clips and the door frame.

28. The method of claim 26 further comprising:

inserting a fastener through the terminal lip of the door frame and into a V-shaped tab on each extension tab wherein the V-shaped tab focuses and captures the fastener.

* * * * *